US010077127B2

(12) United States Patent
Matheyka

(10) Patent No.: US 10,077,127 B2
(45) Date of Patent: Sep. 18, 2018

(54) METHOD AND ARRANGEMENT FOR TREATING BAGS TO BE FILLED WITH A PRODUCT PRIOR TO FILLING THE BAGS WITH A PRODUCT

(75) Inventor: Thomas Matheyka, Eppstein (DE)

(73) Assignee: KHS GmbH, Dortmund (DE)

( * ) Notice: Subject to any disclaimer, the term of this patent is extended or adjusted under 35 U.S.C. 154(b) by 884 days.

(21) Appl. No.: 12/505,168

(22) Filed: Jul. 17, 2009

(65) Prior Publication Data

US 2010/0005760 A1 Jan. 14, 2010

Related U.S. Application Data

(63) Continuation-in-part of application No. PCT/EP2007/010944, filed on Dec. 13, 2007.

(30) Foreign Application Priority Data

Jan. 17, 2007 (DE) ..... 10 2007 003 334

(51) Int. Cl.
*B65B 1/02* (2006.01)
*B65B 55/08* (2006.01)
*B65B 55/02* (2006.01)

(52) U.S. Cl.
CPC ..... *B65B 55/08* (2013.01); *B65B 55/025* (2013.01)

(58) Field of Classification Search
CPC ..... B65B 55/08; B65B 55/025
USPC ..... 53/558, 561, 235, 167, 426, 425
See application file for complete search history.

(56) References Cited

U.S. PATENT DOCUMENTS

| | | | | |
|---|---|---|---|---|
| 3,934,042 | A * | 1/1976 | De Stoutz | 426/248 |
| 3,972,153 | A * | 8/1976 | Kiellarson et al. | 53/426 |
| 4,063,890 | A * | 12/1977 | Baron | 422/24 |
| 4,175,140 | A * | 11/1979 | Bachmann et al. | 426/399 |
| 4,193,204 | A * | 3/1980 | Nerod | 34/275 |
| 4,297,583 | A * | 10/1981 | Nerod | 250/453.11 |
| 4,396,582 | A * | 8/1983 | Kodera | 422/300 |
| 4,469,835 | A * | 9/1984 | Laurin | 524/349 |
| 5,786,598 | A | 7/1998 | Clark | |
| 6,202,384 | B1 | 3/2001 | Kurth et al. | |
| 6,929,040 | B2 * | 8/2005 | Py | 141/329 |

(Continued)

FOREIGN PATENT DOCUMENTS

| | | |
|---|---|---|
| DE | 40 07 714 | 9/1991 |
| DE | 42 09 838 | 9/1993 |
| DE | 196 13 357 | 10/1997 |

(Continued)

OTHER PUBLICATIONS

English translation of Chinese Office Action 200780049884.8.

(Continued)

*Primary Examiner* — Sameh Tawfik
(74) *Attorney, Agent, or Firm* — Nils H. Ljungman & Associates

(57) ABSTRACT

The present application disclosed a method for sterilizing flexible containers using a flexible container sterilizing arrangement. Such containers may comprise bags, pouches, or similar containers. The method comprises moving container material, using a conveying arrangement of the flexible container sterilizing arrangement, through an entry port into a housing of the flexible container sterilizing arrangement. The entry port is formed by a container-material sterilizing device.

20 Claims, 4 Drawing Sheets

(56) References Cited

U.S. PATENT DOCUMENTS

| | | | |
|---|---|---|---|
| 2003/0155531 A1 | 8/2003 | Clark et al. | |
| 2007/0172560 A1* | 7/2007 | Mirtsching et al. | 426/325 |

FOREIGN PATENT DOCUMENTS

| | | | |
|---|---|---|---|
| DE | 196 26 705 | | 1/1998 |
| EP | 02 06 096 | | 12/1986 |
| EP | 05 91 917 | | 4/1994 |
| EP | 1 598 391 | | 11/2005 |
| FR | 2 649 668 | | 1/1991 |
| FR | 2649668 | A1 | 1/1991 |
| GB | 1 166 010 | | 10/1969 |
| JP | 60246758 | A | 12/1985 |
| JP | 62235027 | A | 10/1987 |
| JP | 1199831 | A | 8/1989 |
| JP | 2000511497 | A | 9/2000 |
| JP | 2002019739 | A | 1/2002 |
| JP | 2003054521 | A | 2/2003 |
| JP | 2003160111 | A | 6/2003 |
| JP | 2006526549 | A | 11/2006 |
| WO | WO 98/05555 | | 2/1998 |
| WO | WO 98/05703 | | 2/1998 |
| WO | WO 9805703 | A1 | 2/1998 |
| WO | WO 99/21593 | | 5/1999 |
| WO | WO 05/120960 | | 12/2005 |

OTHER PUBLICATIONS

International Search Report PCT/EP2007/010944 and English translation thereof.

International Preliminary Report on Patentability PCT/EP2007/010944 and English translation thereof.

* cited by examiner

METHOD AND ARRANGEMENT FOR TREATING BAGS TO BE FILLED WITH A PRODUCT PRIOR TO FILLING THE BAGS WITH A PRODUCT

CONTINUING APPLICATION DATA

This application is a Continuation-In-Part application of International Patent Application No. PCT/EP2007/010944, filed on Dec. 13, 2007, which claims priority from Federal Republic of Germany Patent Application No. 10 2007 003 334.8, filed on Jan. 17, 2007. International Patent Application No. PCT/EP2007/010944 was pending as of the filing date of this application. The United States was an elected state in International Patent Application No. PCT/EP2007/010944.

BACKGROUND

1. Technical Field

The present application relates to a method and arrangement for treating bags to be filled with a product prior to filling the bags with a product.

2. Background Information

Background information is for informational purposes only and does not necessarily admit that subsequently mentioned information and publications are prior art.

The present application relates to a treatment arrangement for treating bags or bag packages before the bags or bag packages are filled with a product or ingredient of a product. Such treatment arrangements are used in the food and beverage industries to promote prolonged shelf lives of the products housed in the bag packages or flexible pouches. Additionally, such treatment arrangements are used in the food and beverage industries to restrict or minimize contamination of bag material and/or bag packages after the bag material and/or bag packages have been treated by the treatment arrangements.

Treatment arrangements for treating bags or bag packages may be found in plants for producing bags or bag packages as well as fill and seal bags or bag packages.

The present application relates to a treating device for bag packages, which treating device comprises an entry port, a shaping unit, a filling unit, an exit port and one or more suitable conveying and/or transport elements.

In addition, the present application includes a method for using the treating device.

The present application relates to a sterilizing device for bag packages, said sterilizing device comprising an entry port, a shaping unit, a filling unit, an exit port and one or more suitable conveying and/or transport elements, wherein the entry port includes a UV radiation device or is formed in a substantial manner from said UV radiation device, and said UV radiation device emits pulsed radiation at high power. In addition the present application includes a method for using said sterilizing device.

Sterilizing devices and sterilizing methods are widely known in the foodstuffs industry and the beverage industry. The technology for solid, rigid containers, bottles or the like that have a monolithic body that has been produced by means of blowing or deep-drawing processes is very sophisticated. The surfaces are smooth and substantially without grooves, folds or the like that are difficult to access.

In the case of flexible bag packages, contrary to this, the production processes produce a less smooth surface that is provided with transitions and undercuts. Bent edges, glued surfaces and folded regions that give rise to narrow grooves, folds, edges and/or the like have to be put up with when shaping the bag.

For many liquids and products that are customarily filled into flexible bags, heat treating the filled bag is not desirable as losses in product quality are a consequence of the heat treatment. Consequently, there is great interest in aseptic cold filling. Along with known cleaning steps in water, steam or sterilizing liquids, sterilizing with $H_2O_2$ is very widespread in the area of industrial filling machines for beverages.

Even if this system works in principle, the degree of wetting of the surface to be sterilized in as short a time as possible is limited and an increase in throughput speed with an even lower bacterial count is not achievable with such a system or is achievable with unjustifiably high expenditure.

Sterilizing the foil material used to produce said bags before the processing procedures is also known, as is carrying out the production of the bags as such in a clean-room. Some methods for sterilization involve guiding the foil material in a first step via a wet cleaning station, where the foil is pre-cleaned. The foil pre-cleaned in such a manner is then moved past a UV light source in order to achieve the desired rate of germ killing.

In some methods for sterilization, the pre-cleaning in the first step in these cases also being performed by using a suitable liquid bath. Downstream of this first treatment step, the foil is guided upwards in a shaft so that the liquid can drain away, suitable wipers of the other drying devices being positioned upstream of the UV lamp. This wet, partly mechanical cleaning step is necessary and/or desired in order to remove germs in an appreciable manner in this first step, as the single UV radiation is not sufficient with the band material running at high speeds.

It can easily be understood that this wet, mechanical treatment of the foils is time-consuming and expensive and is responsible, where applicable, for the incomplete removal of liquid residue, incomplete drying and even product degradation.

OBJECT OR OBJECTS

Consequently, it is an object of the present application to disclose the methods and a device that do not have the afore-mentioned shortcomings and that do enable the foil material to be put through at high speeds.

SUMMARY

This object is achieved through the sterilizing device according to the present application for bag packages which include as essential components an entry port, a shaping unit, a filling unit, an exit port and one or more suitable conveying and/or transport elements. The entry port, in this case, includes a UV radiation device or the entry port is formed substantially by said UV radiation device. The UV radiation device is capable of emitting pulsed radiation at high power or at very high power.

In one possible embodiment, the UV radiation device has a radiation output of between 10 and 50 kiloWatts per centimeter squared (kWatt/cm$^2$). In at least one possible embodiment according to the present application, radiation output is within the range of between 15 and 25 kWatt/cm$^2$. In one possible embodiment of this present application, this pulsed radiation is the extremely high rate at which germs, bacteria and viruses are killed off. The duration of the radiation pulse is within the range of 100 micro (μ) seconds to 500 μ seconds and in one possible embodiment of the present application is within the range of 250 μ seconds to 350 μ seconds. Through this pulsed input, overheating and, where applicable, subsequent damage to the material of the foil are avoided, restricted, and/or minimized.

The combination of photo-thermal and photo-chemical reactions results in a very sharp rise in pressure and temperature on cell coverings, the UV proportion of the radiation thereby effectively destroying the DNA building blocks, which results in the killing of bacteria, fungus spores and viruses. Without a wet cleaning step and without the use of additional germ-killing substances, a germ reduction of log 3 to log 5 is achieved.

The sterilizing device can be further developed to the effect that gas inlets are provided thereon, said gas inlets leading into the interior space bordering the entry port. By means of said gas supply, excess pressure can be generated in the interior space and the penetrating of pathogenic germs, spores, etc. is reliably inhibited or restricted to an admissible amount.

In one possible embodiment of the present application, the entry port is connected to a gas line and at least one gas outlet is positioned at the entry port, it being possible to generate a gas flow by means of said gas outlet in normal operation in opposition to the direction of movement of the foil. The said gas flow, which flows through the port parallel or substantially parallel to and in the opposite direction to the conveying direction of the foil, along with the blocking effect also has a cooling effect for the foil in the area of the UV radiation.

The sterilizing device can be developed to the effect that a roll reservoir is positioned upstream of the entry port, said roll reservoir being connected to the entry side of the sterilizing device in a fixed or a detachable manner. By means of suitable guiding or conveying elements, the foil can be directed in operation from the roll reservoir into the entry port.

In addition, the present application includes a method for sterilizing bag packages, where the sterilizing device in one of the afore-mentioned embodiment variants is used. In this case, a) in a first step foil material is directed from a roll or from another reservoir into the entry port, b) the foil is then exposed to pulsed UV radiation in the region of the entry port at least on one side and in one possible embodiment on both sides, c) the foil is then formed into bag packages and subsequently d) said empty bag packages are filled and sealed and, as the last step, e) the filled bag packages are lifted or conveyed out of the sterilizing device by means of suitable conveying means.

The method according to the present application for sterilizing bag packages can be improved if the internal pressure in the sterilizing device is higher than the ambient pressure and consequently a gas flow is directed through the port from inside to outside. In one possible embodiment of the present application, a gas flow is directed into the interior of the sterilizing device or at least in the flow direction to the exit of the entry port, wherein the gas has clean-room quality. In one possible embodiment of the present application, during the operation, said gas is cleaned by means of filter elements or diaphragm modules before being introduced into the interior space of the sterilizing device.

Various types of films or other sheet materials may be used with the method and apparatus of the present application. For example, the bag packages may be comprised of thermoplastic film, polymer, paper/poly material, polymeric material, polyolefin, polystyrene, polyurethane, polyester, laminates, metallized plastic, metallized paper, plasticized paper, and other types of sheet material.

One example of such a sheet material may include a metallocene polyethylene (mPE), known by the brand name Exceed™, manufactured by ExxonMobil, having the mailing address 5959 Las Colinas Boulevard, Irving, Tex. 75039. Another sheet material may include FLEXOMER™ very low density polyethylene resin, manufactured by The Dow Chemical Company, having the mailing address Dow Ashman Center, 4520 Ashman Street, P.O. Box 1206, Midland, Mich. 48642. Yet another sheet material may include a high performance thermoplastic polyester elastomer, known by the brand name Hytrel® 4068FG, manufactured by DuPont Engineering Polymers, having the mailing address E.I. duPont de Nemours & Co., Wilmington, Del. 19898.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

One possible embodiment of the sterilizing device according to the present application is represented in which.

DESCRIPTION OF EMBODIMENT OR EMBODIMENTS

Figure 1:
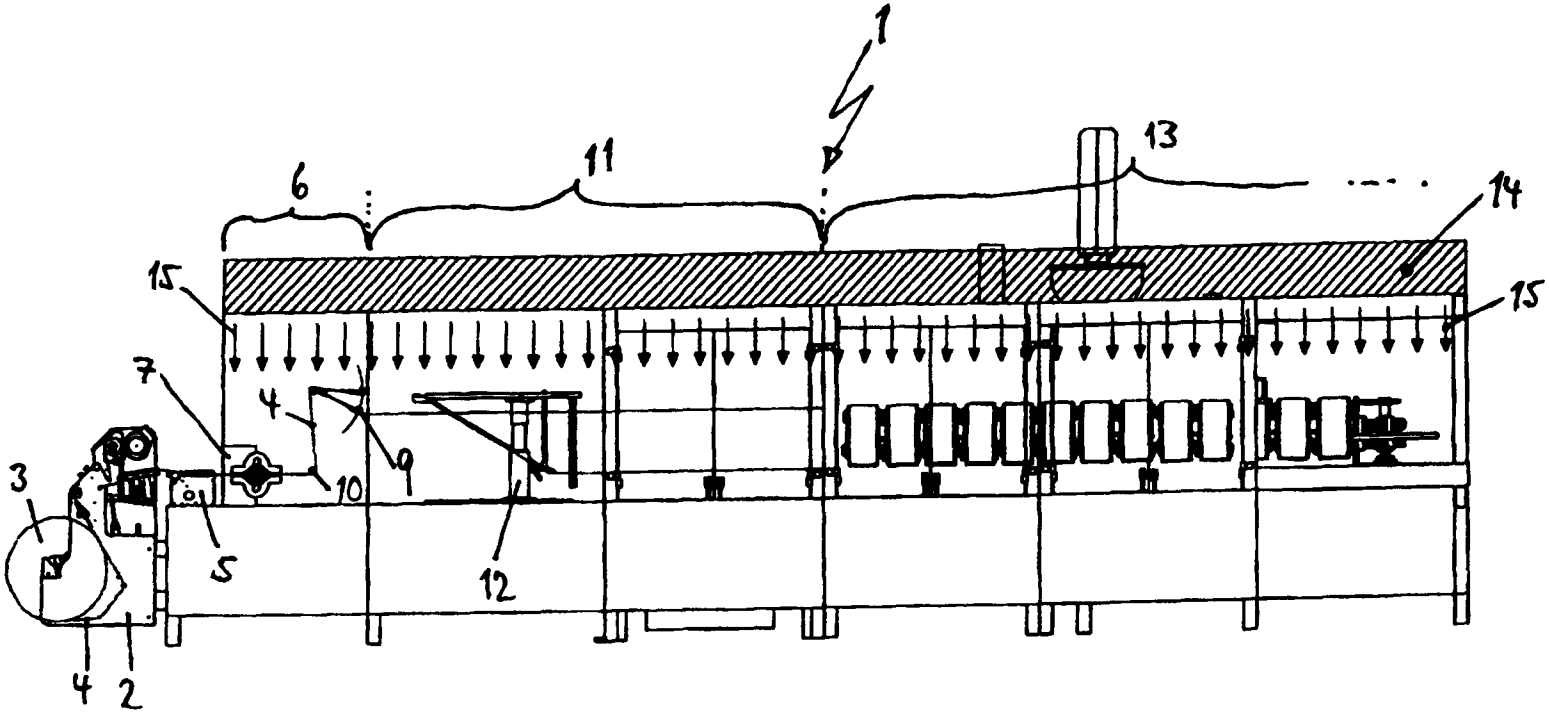
FIG. 1 shows a diagrammatic sectional drawing.

FIG. 1 shows a receiving device 2 that is positioned at the entry side of the sterilizing device 1, on which receiving device the foil roll 3, also called the reservoir roll, is mounted. Said foil roll 3 is rotated in a substantially continuous manner during routine operation. The foil 4 is directed via a punching station 5 where necessary and/or desired stability punching can be performed. The foil 4 then runs into the radiation segment 6, which as essential elements includes the entry port 7 and the UV radiation device 8, and as shown in the example a format compensating rocker 9 and suitable guide elements 10 in the form of rolls or rollers.

The bag producing segment 11 connects to the radiation segment 6, in which bag producing segment the empty bag packages are manufactured using suitable means, for example a folding and moulding machine 12. The empty bag packages are transferred into the filling segment 13 and there are filled and sealed and they leave the sterilizing device 1 by means of a port (not shown). In the device represented, a ventilation ceiling 14 extends over the entire length of the sterilizing device 1. The said ventilation ceiling 14 includes a filtering material and serves to generate a laminar, turbulence-free flow, the direction of flow being indicated in a symbolic manner by the arrows 15 that point vertically downwards. The gas outlets are not shown.

Figure 2:
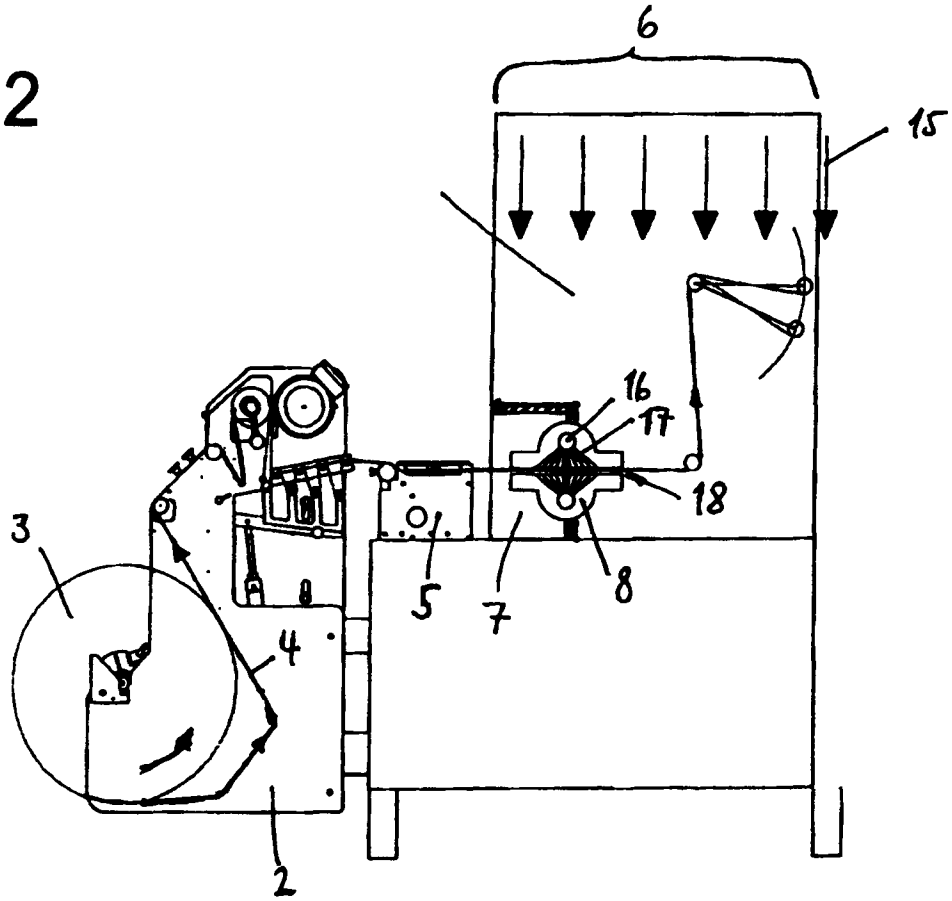
FIG. 2 shows a detailed view of the entry port with the UV radiation device in position there.

FIG. 2 is a detailed view of the receiving device 2, the punching station 5 and the radiation segment 6 with the entry port 7 and the UV radiation device 8. It can be clearly seen that the foil 4 is irradiated on both sides by the radiation source 16 in the region of the UV radiation device 8. In this case, the fan-shaped lines symbolize the UV rays 17. It can also be seen that the horizontal through channel 18 represents the portal into the interior of the sterilizing device 1.

In at least one possible embodiment of the present application, the ultraviolet radiation device or ultraviolet light source 8 may be configured to output radiation or ultraviolet light in the range of about ten kiloWatts per centimeter squared to about fifty kiloWatts per centimeter squared. In another possible embodiment of the present application, the ultraviolet radiation device or ultraviolet light source 8 may be configured to output radiation or ultraviolet light in the range of about fifteen kiloWatts per centimeter squared to about twenty-five kiloWatts per centimeter squared. In another possible embodiment of the present application, the higher range of output of the ultraviolet radiation device or ultraviolet light source may possibly be configured to output radiation or ultraviolet light possibly as high as two hundred fifty kiloWatts per centimeter squared.

Figure 3:
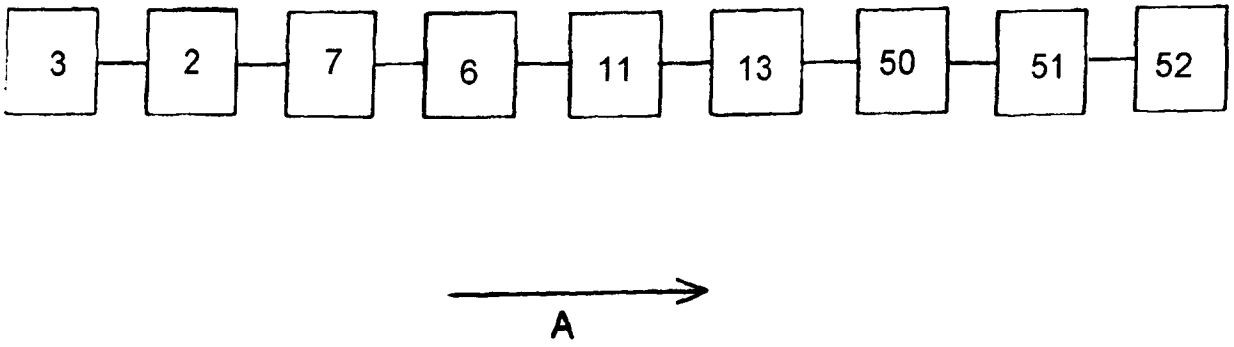
FIG. 3 is a block diagram of one possible embodiment of the present application.

FIG. 3 is a block diagram of one possible embodiment of the present application. As seen in FIG. 3, a sheet material may be supplied from a roll or reservoir 3 to an entry point 2 of a sterilization device or treatment arrangement 1. From the entry point 2, the sheet material 4 may be fed to a radiation segment or light-exposing unit 6. The sheet material 4 may be exposed to pulsed ultraviolet light in the segment 6 on one side. In another possible embodiment of the present application, the sheet material 4 may be exposed to pulse ultraviolet on both sides.

Once sterilized and/or treated and/or exposed to ultraviolet light, the sheet material 4 may be transported to a bag-producing segment or a bag forming unit 11. In the bag-producing segment or a bag forming unit 11, the sheet material 4 may then be cut, folded, and/or welded to form a bag or bag package. The bag may then be transported to a filling segment 13, in which the bag may be filled with any of a variety of products or ingredients. Next, the bag may then be transported to a closing segment or sealing unit 50, in which the filled bag or bag package may be sealed, closed, or welded. The filled, closed bag may then be transported out of the sterilization machine 1 through an exit point 51 and to a packaging arrangement 52, in which filled, sealed bag packages may be placed into boxes for distribution.

The sheet material 4, which may later form the bags or bag packages, may be transported in a direction of transport A.

In at least one possible embodiment of the present application, the sheet material 4 may be used in at least the segment 11 and segment 13 within a predetermined time after the sheet material 4 is processed by the segment 6 to restrict and/or minimize contamination of the sheet material 4.

Figure 4:
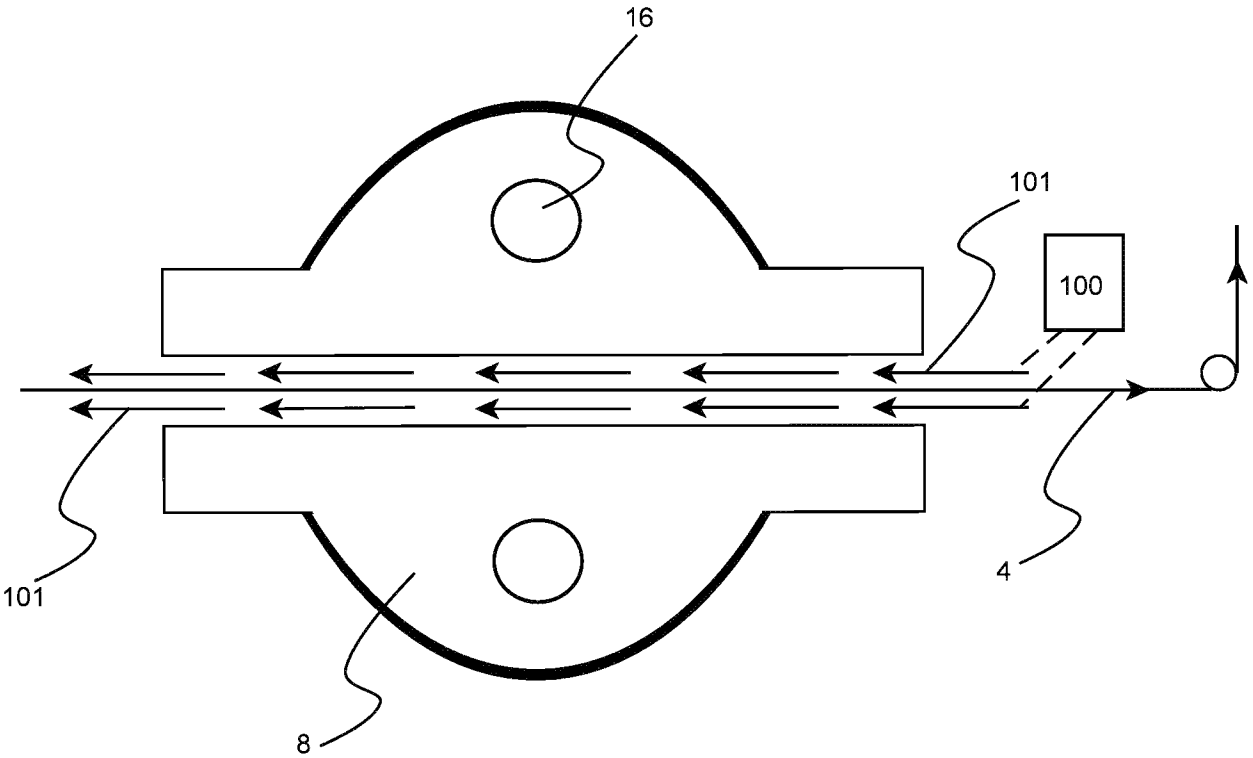
FIG. 4 shows schematically the UV radiation device 8 at the entry port in accordance with one possible embodiment of the present application.

In accordance with one possible embodiment of the present application, FIG. 4 shows schematically the UV radiation device 8 at the entry port. At least one gas outlet 100 is positioned at the entry port, it being possible to generate a gas flow 101 by means of said gas outlet in normal operation in opposition to the direction of movement of the foil 4. The said gas flow 101, which flows through the port parallel or substantially parallel to and in the opposite direction to the conveying direction of the foil 4, along with the blocking effect also has a cooling effect for the foil in the area of the UV radiation generated by the radiation source 16.

One feature or aspect of an embodiment is believed at the time of the filing of this patent application to possibly reside broadly in a sterilizing device for bag packages, said sterilizing device comprising an entry port, a shaping unit, a filling unit, an exit port and one or more suitable conveying and/or transport elements, wherein the entry port includes a UV radiation device or is formed in a substantial manner from said UV radiation device, and said UV radiation device emits pulsed radiation.

Another feature or aspect of an embodiment is believed at the time of the filing of this patent application to possibly reside broadly in the sterilizing device, wherein the radiation output of the UV radiation device is between 10000 and 50000 Watt/cm$^2$ and in one possible embodiment between 15000 and 250000 Watt/cm$^2$.

Yet another feature or aspect of an embodiment is believed at the time of the filing of this patent application to possibly reside broadly in the sterilizing device, wherein the duration of the radiation pulse is within the range of 100 μ seconds to 500 μ seconds, and in one possible embodiment of the present application is within the range of 250 μ seconds to 350 μ seconds.

Still another feature or aspect of an embodiment is believed at the time of the filing of this patent application to possibly reside broadly in the sterilizing device, wherein the sterilizing device includes gas inlets, which lead into the interior space bordering the entry port.

A further feature or aspect of an embodiment is believed at the time of the filing of this patent application to possibly reside broadly in the sterilizing device, wherein the entry port is connected to a gas line and at least one gas outlet is positioned at the entry port, it being possible to generate a gas flow by means of said gas outlet in normal operation in opposition to the direction of movement of the foil.

Another feature or aspect of an embodiment is believed at the time of the filing of this patent application to possibly reside broadly in the sterilizing device, wherein a roll reservoir is positioned upstream of the entry port.

Yet another feature or aspect of an embodiment is believed at the time of the filing of this patent application to possibly reside broadly in a method for sterilizing bag packages, wherein a sterilizing device of the present application is used, wherein:

a) in a first step foil material is directed from a roll or other reservoir into the entry port, b) the foil is exposed to pulsed UV radiation in the region of the entry port at least on one side and in one possible embodiment on both sides, c) the foil is then formed into bag packages and subsequently d) filled and sealed and, as the last step, and e) is lifted or conveyed out of the sterilizing device by means of suitable conveying means.

Still another feature or aspect of an embodiment is believed at the time of the filing of this patent application to possibly reside broadly in the method for sterilizing bag packages, wherein the internal pressure in the sterilizing device is higher than the ambient pressure and consequently a gas flow is directed through the port from inside to outside.

A further feature or aspect of an embodiment is believed at the time of the filing of this patent application to possibly reside broadly in the method, wherein a gas flow is directed into the interior of the sterilizing device or at least to the exit of the entry port, wherein the gas has clean-room quality.

One feature or aspect of an embodiment is believed at the time of the filing of this patent application to possibly reside broadly in a method of treating, forming, filling, and sealing bag packages, said method comprising the steps of: storing a roll of thermoplastic sheet material; unrolling said thermoplastic sheet material from said roll and feeding said thermoplastic sheet material, from said roll of thermoplastic sheet material, to a treating arrangement, which treating arrangement comprises: an input being configured and disposed to accept thermoplastic sheet material from a roll of thermoplastic sheet material and to feed thermoplastic sheet material into said treating arrangement; a treating unit being configured and disposed to treat thermoplastic sheet material; a forming unit being configured and disposed to cut thermoplastic sheet material, to fold thermoplastic sheet material, and to weld thermoplastic sheet material and thereby to form bag packages; a gripping arrangement being configured and disposed to grip sides of formed bag packages to permit bag packages to be opened and to permit bag packages to be filled; a filling unit being configured and disposed to fill formed bag packages; a sealing unit being configured and disposed to seal filled bag packages; and an output being configured and disposed to permit bag packages to be removed from said treatment arrangement; exposing both sides of said thermoplastic sheet material to pulsed ultraviolet light, in said treating unit, from a source of ultraviolet light; outputting ultraviolet light to expose said thermoplastic sheet material from about fifteen thousand Watts per centimeter squared and about twenty-five thousand Watts per centimeter squared in said treating unit; said outputting comprising pulses of ultraviolet light from about two hundred fifty microseconds to about three hundred fifty microseconds in said treating unit; cutting a predetermined portion of said ultraviolet light-exposed thermoplastic sheet material, which predetermined portion of said ultraviolet light-exposed thermoplastic sheet material comprises a first edge of said predetermined portion of said ultraviolet light-exposed thermoplastic sheet material and a second edge being disposed opposite said first edge of said predetermined portion of said ultraviolet light-exposed thermoplastic sheet material; folding said predetermined portion of said ultraviolet light-exposed thermoplastic sheet material, disposing said first edge adjacent said second edge, and disposing said first edge and said second edge opposite a fold in said predetermined portion of said ultraviolet light-exposed thermoplastic sheet material; welding three sides of said folded predetermined portion of said ultraviolet light-exposed thermoplastic sheet material and forming bag packages with an open portion, in said forming unit, from said ultraviolet light-exposed thermoplastic sheet material, which bag packages are configured to accept a product; transporting said formed bag packages, from said forming unit, to said filling unit; gripping the sides of said bag packages and opening said bag packages; filling said bag packages, in said filling unit, with a product; transporting said filled bag packages from said filling unit to said sealing unit; welding the remaining open portion of said filled bag packages, in said sealing unit, and sealing said filled bag packages; said steps of cutting, folding, welding three sides, transporting said formed bag packages, gripping, filling, transporting said filled bag packages, and welding the remaining open portion further comprising cutting, folding, welding three sides, transporting said formed bag packages, gripping, filling, transporting said filled bag packages, and welding the remaining open portion within a predetermined time after said step of exposing both sides of said thermoplastic sheet material to pulsed ultraviolet light to minimize contamination of said light-exposed thermoplastic sheet material; transporting said sealed, filled bag packages out of said treating arrangement; and packaging said sealed, filled bag packages into boxes.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

The following patents, patent applications or patent publications, are hereby incorporated by reference as if set forth in their entirety herein: WO 05/120960 A1, having the title "DEVICE FOR THE SHAPING, FILLING AND SEALING OF CONTAINERS OF FLEXIBLE AND SOFT LAMINAR MATERIAL," published on Dec. 22, 2005; GB 1,166,010 A, having the title "Improvements in or relating to Devices for Cleaning Films of Plastic Material Entering a Sterile Enclosure," published on Oct. 1, 1969; DE 40 07 714 A1, having the following English translation of the German title "Method and device for sterilising a web of packaging material," published on Sep. 12, 1991; DE 42 09 838 A1, having the following English translation of the German title "Sterilising system for lengths of packing material—uses high pressure water jet sprayed onto continuously moving material surface prior to sterile gas drying and UV radiation," published on Sep. 30, 1993; DE 196 26 705 A1, having the following German title "Verfahren und Vorrichtung zum Sterilisieren einer Verpackungsmaterialbahn," published on Jan. 8, 1998; WO 99/21593 A1, having the title "METHOD AND APPARATUS FOR STERILIZING A PACKAGING SHEET MATERIAL," published on May 6, 1999; and DE 196 13 357 A1, having the following English translation of the German title "Pulsed light source e.g. gas-discharge lamp for generating light of given wavelength in UV and visible light spectral range," published on Oct. 9, 1997.

All of the patents, patent applications or patent publications, which were cited in the German Office Action dated Oct. 4, 2007, and/or cited elsewhere are hereby incorporated by reference as if set forth in their entirety herein as follows: U.S. Pat. No. 6,202,384, having the title "ARRANGEMENT FOR DEGERMING WEBS OF PACKING FOIL," published on Mar. 20, 2001; FR 1,469,214, having the French title "Dispositif de stérilisation de films en matière plastique pour le conditionnement de produits divers," published on May 8, 1967; EP 0 591 917, having the title "A method of sterilizing the inside layer in a packaging material," published on Apr. 13, 1994; US 2003/0155531, having the title "STERILIZATION OF PACKAGES AND THEIR CONTENTS USING LIGHT," published on Aug. 21, 2003; and EP 0 206 086, having the title "Active energy ray-curing resin composition," published on Dec. 30, 1986.

All of the patents, patent applications or patent publications, which were cited in the International Search Report dated Apr. 11, 2008, and/or cited elsewhere are hereby incorporated by reference as if set forth in their entirety herein as follows: FR 2,649,668, having the following English translation of the French title "ASEPTIC FILLING MACHINE FOR FOOD," published on Jan. 18, 1991; WO 98/05703, having the title "METHOD OF TRIGGERING OXYGEN SCAVENGING COMPOSITION WITH PULSED LIGHT," published on Feb. 12, 1998; EP 1,598,391, having the title "METHOD AND APPARATUS FOR HIGH SPEED ACTIVATION OF OXYGEN SCAVENGING COMPOSITIONS," published on Nov. 23, 2005; WO 98/05555, having the title "METHOD, APPARATUS, AND A SYSTEM FOR TRIGGERING OXYGEN SCAVENGING FILMS," published on Feb. 12, 1998; and U.S. Pat. No. 5,786,598, having the title "STERILIZATION OF PACKAGES AND THEIR CONTENTS USING HIGH-INTENSITY, SHORT-DURATION PULSES OF INCOHERENT, POLYCHROMATIC LIGHT IN A BROAD SPECTRUM," published on Jul. 28, 1990.

U.S. patent application Ser. No. 12/341,564 filed on Dec. 22, 2008, having inventor Thomas MATHEYKA, and its corresponding Federal Republic of Germany Patent Application No. DE 10 2006 028 796.7, and International Patent Application No. PCT/EP2007/05299, filed on Jun. 20, 2007, having WIPO Publication No. WO 2007/147566 and inventor Thomas MATHEYKA are hereby incorporated by reference as if set forth in their entirety herein.

U.S. patent application Ser. No. 12/342,440 filed on Dec. 23, 2008, having inventor Thomas MATHEYKA, and its corresponding Federal Republic of Germany Patent Application No. 10 2006 030 255.9, filed on Jul. 30, 2006, and International Patent Application No. PCT/EP2007/008402, filed on Jun. 20, 2007, having WIPO Publication No. WO 2008/000376 and inventor Thomas MATHEYKA are hereby incorporated by reference as if set forth in their entirety herein.

Some examples of apparatuses for opening and disposing bags and of gripping arrangements that may possibly be utilized or adapted for use in at least one possible embodiment may possibly be found in the following a U.S. Pat. No. 4,108,300, having the title "BAG PACKING APPARATUS," published on Aug. 2, 1978; and U.S. Pat. No. 6,276,117, having the title "ADJUSTABLE POUCH CARRIER FOR DIFFERENT SIZED POUCHES AND PACKAGING MACHINE HAVING AN ADJUSTABLE POUCH CARRIER," published on Aug. 21, 2001.

Some examples of apparatuses for closing arrangements that may possibly be utilized or adapted for use in at least one possible embodiment may possibly be found in US Patent Application No. 2007/0101684, having the title "DEVICE FOR THE PRODUCTION OF TUBULAR BAGS," published on May 10, 2007.

Some examples of sheet materials, which may possibly be utilized or adapted for use in at least one possible embodiment of the present application, may possibly be found in the following U.S. Pat. No. 7,550,198, having the title "Multilayer sealable film having a temperature-resistant layer therein," published on Jun. 23, 2009; U.S. Pat. No. 7,351,942, having the title "Insulating microwave interactive packaging," published on Apr. 1, 2008; U.S. Pat. No. 7,281,360, having the title "Thermal laminates and laminating method of food packaging films," published on Oct. 16, 2007; U.S. Pat. No. 6,932,592, having the title "Metallocene-produced very low density polyethylenes," published on Aug. 23, 2005; U.S. Pat. No. 6,372,361, having the title "Coating for paper products," published on Apr. 16, 2002; and U.S. Pat. No. 5,405,663, having the title "Microwave package laminate with extrusion bonded susceptor," published on Apr. 11, 1995.

Some examples of methods and apparatus for forming bags out of sheet material, which may possibly be utilized or adapted for use in at least one possible embodiment of the present application, may possibly be found in the following U.S. Pat. No. 7,553,269, having the title of "Method of manufacturing a bag," published on Jun. 30, 2009; U.S. Pat. No. 7,549,269, having the title "Method of forming a bag having a reclosable seal," published on Jun. 23, 2009; U.S. Pat. No. 7,546,722, having the title "Vertical filling-packaging machine and method of manufacturing a packaging bag," published on Jun. 16, 2009; U.S. Pat. No. 7,396,163, having the title "Paper and plastic bags flexible packages and other containers with re-closable device and method of making the same," published on Jul. 8, 2008; U.S. Pat. No. 7,033,077, having the title "Sealable bags made of plastics or other materials and method of making plastic sheeting for manufacturing sealable bags," published on Apr. 25, 2006; U.S. Pat. No. 7,361,872, having the title "Variable serving size insulated packaging," published on Apr. 22, 2008; U.S. Pat. No. 5,773,801, having the title "Microwave cooking construction for popping corn," published on Jun. 30, 1998; U.S. Pat. No. 7,067,781, having the title "Single ply paper product, method for manufacturing, and article," published on Jun. 27, 2006; and U.S. Pat. No. 4,348,851, having the title "Packing machine for the production of filled sealed bags," published on Sep. 14, 1982.

Some examples of apparatuses and methods for packaging filled, sealed bags into boxes, which may possibly be utilized or adapted for use in at least one possible embodiment of the present application, may possibly be found in the following U.S. Pat. No. 7,361,850, having the title "Method and apparatus for counting items in a container," published in Apr. 22, 2008; U.S. Pat. No. 6,988,350, having the title "Packaging system," published in Jan. 24, 2006; and U.S. Pat. No. 5,251,422, having the title "Potato chip package vertical packaging machine," published on Oct. 12, 1993.

The patents, patent applications, and patent publication listed above in the preceding ten paragraphs are herein incorporated by reference as if set forth in their entirety. The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2007 003 334.8, filed on Jan. 17, 2007, having inventor Thomas MATHEYKA, and DE-OS 10 2007 003 334.8 and DE-PS 10 2007 003 334.8, and International Application No. PCT/EP2007/010944, filed on Dec. 13, 2007, having WIPO Publication No. WO 2008/086868 and inventor Thomas MATHEYKA, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the corresponding foreign equivalent patent application(s), that is, PCT/EP2007/010944 and German Patent Application 10 2007 003 334.8, is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/010944 and DE 10 2007 003 334.8 from which this patent application claims priority which do not have to do with the correction of the translation in this patent application are not to be included in this patent application in the incorporation by reference.

Any statements about admissions of prior art in the original foreign patent applications PCT/EP2007/010944 and DE 10 2007 003 334.8 are not to be included in this patent application in the incorporation by reference, since the laws relating to prior art in non-U.S. Patent Offices and courts may be substantially different from the Patent Laws of the United States.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. § 1.72(b). As stated in 37 C.F.R. § 1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A method of sterilizing flexible containers, which containers comprise bags, pouches, or similar containers, using a flexible container sterilizing arrangement, said method comprising the steps of:

moving container material, using a conveying arrangement of said flexible container sterilizing arrangement, through an entry port into a housing of said flexible container sterilizing arrangement, which entry port is formed by a container-material sterilizing device;

emitting pulses of ultraviolet radiation, using said container-material sterilizing device, and thereby treating, with ultraviolet radiation, one or both sides of said container material passing through said container-material sterilizing device;

directing a flow of gas out of said housing through said entry port parallel or substantially parallel to the container material and in a direction opposite the direction of movement of said container material into said housing;

forming said treated container material into flexible containers using a container-material forming unit of said flexible container sterilizing arrangement;

filling and sealing the flexible containers using a container filling unit of said flexible container sterilizing arrangement; and moving the flexible containers through an exit port of said housing and out of said flexible container sterilizing arrangement with said conveying arrangement.

2. The method according to claim 1, wherein said step of emitting pulses of ultraviolet radiation comprises emitting pulses of ultraviolet radiation in the range of 100 microseconds to 500 microseconds in duration.

3. The method according to claim 2, wherein said method comprises sterilizing container material by destroying bacteria, fungus spores, and viruses, using solely pulses of ultraviolet radiation.

4. The method according to claim 3, wherein said step of directing a flow of gas out of said housing through said entry port comprises:

flowing gas through a gas line connected to said entry port;

flowing said gas out of a gas outlet positioned at said entry port;

flowing said gas into said entry port;

flowing said gas through said entry port, in a direction substantially parallel to the direction of movement of said container material into said housing, and then out of said entry port; and producing a cooling effect, with said gas from said gas line, on the container material being moved through said entry port while the container material is being treated with ultraviolet radiation, and inhibiting movement, with said gas from said gas line, of microorganisms, viruses, and spores from the environment into said housing.

5. The method according to claim 2, wherein said step of emitting pulses of ultraviolet radiation comprises emitting pulses of ultraviolet radiation in the range of 10,000 to 50,000 watts/cm$^2$.

6. The method according to claim 5, wherein said method further comprises:

flowing gas through gas inlets into the interior of said flexible container sterilizing arrangement; and pressurizing the interior of said flexible container sterilizing arrangement to a pressure higher than the ambient pressure outside said flexible container sterilizing arrangement, and thereby causing said flow of gas through said entry port.

7. The method according to claim 6, wherein said step of flowing gas comprises directing a flow of said gas out through said exit port, which said gas is sterilized gas.

8. The method according to claim 5, wherein said step of directing a flow of gas out of said housing through said entry port comprises:

flowing gas through a gas line connected to said entry port;

flowing said gas out of a gas outlet positioned at said entry port;

flowing said gas into said entry port;

flowing said gas through said entry port, in a direction substantially parallel to the direction of movement of said container material into said housing, and then out of said entry port; and producing a cooling effect, with said gas from said gas line, on the container material being moved through said entry port while the container material is being treated with ultraviolet radiation, and inhibiting movement, with said gas from said gas line, of microorganisms, viruses, and spores from the environment into said housing.

9. The method according to claim 1, wherein said step of emitting pulses of ultraviolet radiation comprises emitting pulses of ultraviolet radiation in the range of 250 microseconds to 350 microseconds in duration.

10. The method according to claim 9, wherein said step of emitting pulses of ultraviolet radiation comprises emitting pulses of ultraviolet radiation in the range of 15,000 to 25,000 watts/$cm^2$.

11. The method according to claim 10, wherein said method comprises sterilizing container material by destroying bacteria, fungus spores, and viruses, using solely pulses of ultraviolet radiation.

12. The method according to claim 10, wherein said step of directing a flow of gas out of said housing through said entry port comprises:

flowing gas through a gas line connected to said entry port;

flowing said gas out of a gas outlet positioned at said entry port;

flowing said gas into said entry port;

flowing said gas through said entry port, in a direction substantially parallel to the direction of movement of said container material into said housing, and then out of said entry port; and producing a cooling effect, with said gas from said gas line, on the container material being moved through said entry port while the container material is being treated with ultraviolet radiation, and inhibiting movement, with said gas from said gas line, of microorganisms, viruses, and spores from the environment into said housing.

13. The method according to claim 9, wherein said step of directing a flow of gas out of said housing through said entry port comprises:

flowing gas through a gas line connected to said entry port;

flowing said gas out of a gas outlet positioned at said entry port;

flowing said gas into said entry port;

flowing said gas through said entry port, in a direction substantially parallel to the direction of movement of said container material into said housing, and then out of said entry port; and producing a cooling effect, with said gas from said gas line, on the container material being moved through said entry port while the container material is being treated with ultraviolet radiation, and inhibiting movement, with said gas from said gas line, of microorganisms, viruses, and spores from the environment into said housing.

14. The method according to claim 1, wherein said step of flowing said gas through said entry port comprises cooling, with said gas, the container material being moved through said entry port while the container material is being treated with ultraviolet radiation.

15. The method according to claim 14, wherein said method further comprises:

flowing said gas through gas inlets into the interior of said housing; and pressurizing the interior of said housing to a pressure higher than the ambient pressure in an environment outside said housing to cause said flow of gas through said entry port.

16. The method according to claim 15, wherein said step of flowing said gas through said entry port comprises inhibiting movement, with said gas, of microorganisms, viruses, and spores from the environment into said housing.

17. The method according to claim 1, wherein said method further comprises:

flowing gas through gas inlets into the interior of said housing; and pressurizing the interior of said housing to a pressure higher than the ambient pressure outside said housing to cause said flow of gas through said entry port.

18. The method according to claim 1, wherein said step of forming said treated container material into flexible containers comprises solely forming foil into foil bags or foil pouches.

19. The method according to claim 1, wherein said method further comprises:

flowing a gas through gas inlets into the interior of said housing;

pressurizing the interior of said housing to a pressure higher than the ambient pressure outside said housing to cause said flow of gas through said entry port;

said step of flowing said gas through said entry port comprises inhibiting movement, with said gas, of microorganisms, viruses, and spores from the environment into said housing; and said step of forming said treated container material into flexible containers comprises solely forming foil into foil bags or foil pouches.

20. The method according to claim 1, wherein said step of directing a flow of gas out of said housing through said entry port comprises:

flowing gas through a gas line connected to said entry port;

flowing said gas out of a gas outlet positioned at said entry port;

flowing said gas into said entry port;

flowing said gas through said entry port, in a direction substantially parallel to the direction of movement of said container material into said housing, and then out of said entry port; and producing a cooling effect, with said gas from said gas line, on the container material being moved through said entry port while the container material is being treated with ultraviolet radiation, and inhibiting movement, with said gas from said gas line, of microorganisms, viruses, and spores from the environment into said housing.

* * * * *